United States Patent [19]

Rauschenberger

[11] Patent Number: 4,684,278

[45] Date of Patent: Aug. 4, 1987

[54] JOINT FOR USE IN COLLAPSIBLE CHAIRS AND THE LIKE

[76] Inventor: Jörg Rauschenberger, Gartenstrasse 8, D-7144 Asperg, Fed. Rep. of Germany

[21] Appl. No.: 844,801

[22] Filed: Mar. 27, 1986

[30] Foreign Application Priority Data

Mar. 28, 1985 [DE] Fed. Rep. of Germany ..... 3511238

[51] Int. Cl.[4] ..... F16C 11/00

[52] U.S. Cl. ..... 403/84; 403/93; 403/101; 297/46; 297/47; 16/365

[58] Field of Search ..... 403/84, 85, 101, 93, 403/95, 92; 297/378, 46, 47; 16/365, 370

[56] References Cited

U.S. PATENT DOCUMENTS

| | | | |
|---|---|---|---|
| 3,232,136 | 2/1966 | Bahmuller | 403/93 X |
| 3,285,654 | 11/1966 | Cramer | 297/46 |
| 3,319,997 | 5/1967 | Clement | 403/84 X |
| 3,352,580 | 11/1967 | Kurz et al. | 16/365 X |
| 3,779,655 | 12/1973 | Toyota | 403/93 |
| 3,918,822 | 11/1975 | Rauschenberger | 16/365 X |

FOREIGN PATENT DOCUMENTS

| | | | |
|---|---|---|---|
| 133940 | 3/1985 | European Pat. Off. | 297/46 |
| 1253961 | 11/1967 | Fed. Rep. of Germany . | |
| 2349264 | 4/1975 | Fed. Rep. of Germany . | |
| 7510679 | 9/1974 | Netherlands | 403/84 |

*Primary Examiner*—Cornelius J. Husar
*Assistant Examiner*—Joseph A. Fischetti
*Attorney, Agent, or Firm*—Peter K. Kontler

[57] ABSTRACT

A joint for use in a collapsible chair has a main component with a stub which is connectable with the seat of the chair and is integral with a housing for the flat shorter arms of first and second two-armed levers each of which is pivotally secured to the housing by a rivet. The longer arm of the first lever is connected to the back and the longer arm of the second lever is connected to the rear foot of the chair. The shorter arms of the levers are coupled to the respective end portions of a link by two pivot members whose axes are parallel to the axes of the rivets. The levers are pivotable relative to the main component between (a) operative positions in which the chair is erected and the axis of the rivet for the first or second lever is disposed in the common plane of the two pivot members, and (b) inoperative positions in which the chair is collapsed and the longer arms of the levers are adjacent and parallel to the stub of the main component.

12 Claims, 5 Drawing Figures

III
III

JOINT FOR USE IN COLLAPSIBLE CHAIRS AND THE LIKE

BACKGROUND OF THE INVENTION

The present invention relates to joints for use in collapsible chairs and other pieces of indoor or outdoor furniture. More particularly, the invention relates to improvements in joints which can be used with advantage in collapsible chairs to articulately connect the back support to the seat as well as to a ground- or floor-contacting part (foot or leg) of a collapsible chair, cot or the like.

It is already known to provide a joint for use in a collapsible chair or the like with a two-piece main component having a stub which is secured to the seat and has two shells pivotally supporting two levers one of which has a stub connected to the back of the chair and the other of which has a stub connected to the rear foot or leg of the chair. As a rule, the levers are pivotable relative to the main component through angles of between 90 and 120 degrees, namely between first positions in which the chair is collapsed for storage or transport and second positions in which the chair is erected and is ready for use. In many instances, the stub of the main component is parallel to the stubs of the two levers in the collapsed position of the chair. The shells of the two-piece main component define a housing for a transmission which couples the levers to each other so that any angular movement of one lever relative to the main component necessarily entails a predetermined angular movement of the other lever with reference to the main component and vice versa.

German Pat. No. 23 49 264 discloses a joint wherein the transmission which is interposed between the two levers comprises a rather bulky gear train having several disc-shaped mating gears. Since the shaping of cut, rolled, ground or similarly machined and finished gears in a manner as is customary in the machine industry would be too expensive for use in the joint of a rather simple collapsible chair or a like low-priced piece of furniture, the disc-shaped gears are simple stampings or similar inexpensive mass-produced parts whose teeth mate with a substantial amount of play. This results in the development of excessive localized stresses and can entail rapid destruction of the joint. Moreover, the teeth of the disc-shaped gears are likely to gather dust and other contaminants.

German Utility Model No. 19 52 927 discloses a joint for use in a three-legged bed. The main component of the joint is articulately connected to the frame of the bed by a link which provides sufficient room for movement of pivotable parts of the collapsible bed between their extended and collapsed positions.

German Auslegeschrift No. 12 53 961 discloses a rather complex joint for a cot, a deck chair or a similar piece of furniture. This joint is designed to allow for movements of the back support to any one of several different positions of inclination with reference to the seat. The drawbacks of this joint are its bulk, complexity (large number of parts), substantial cost and proneness to contamination.

OBJECTS AND SUMMARY OF THE INVENTION

An object of the invention is to provide a joint which can be mass-produced at a reasonable cost, which comprises a small number of relatively simple parts, and which is more compact than heretofore known joints for use in collapsible chairs and similar pieces of furniture.

Another object of the invention is to provide a joint whose useful life is long, even in the absence of any maintenance, which can be used in a wide variety of pieces of furniture as well as for many other purposes, which is not prone to malfunction in response to contamination or as a result of exposure to contaminants in the surrounding atmosphere, and which can be manipulated with ease by children, adolescents, adults and senior citizens.

A further object of the invention is to provide the joint with novel and improved means for maintaining its relatively movable parts in selected positions, particularly for holding the constituents of the joint against movement from those positions in which the commodity wherein the joint is installed is erected and ready for use.

An additional object of the invention is to provide the joint with novel and improved means for coupling its levers for predetermined movement with reference to each other between operative and inoperative positions.

Still another object of the invention is to provide the joint with novel and improved means for connecting the coupling means to other movable parts and with novel and improved means for blocking the movements of mobile parts beyond their end positions.

A further object of the invention is to provide a novel and improved method of selecting the locations of pivot axes about which the mobile parts of the joint can turn relative to each other.

An additional object of the invention is to provide a joint which can be used in known types of collapsible chairs and the like as a superior substitute for heretofore known joints.

The invention resides in the provision of a joint which can be used with advantage in a collapsible chair or in a similar piece of indoor or outdoor furniture. The joint comprises first and second levers which can be respectively connected with the back and a leg of the chair, a main component which can be connected to the seat of the chair and comprises an end portion constituting a bearing element (e.g., a flat housing assembled of two suitably shaped pieces of sheet metal), first and second pivot members (e.g., rivets) which respectively connect the first and second levers to the bearing element, a link having spaced-apart first and second portions, and third and fourth pivot members which respectively connect the first and second portions of the link to the first and second levers. The axes of all four pivot members are parallel to each other and the levers are pivotable with reference to the main component to and from predetermined positions (in which the chair is erected) in which the axes of the third and fourth pivot members and the axis of one of the first and second pivot members (e.g., of the first pivot member) are disposed in or close to a common plane.

One of the third and fourth pivot members is or can be located relatively close to one side of the common plane, and the axis of the other of the first and second pivot members is disposed at the one or the other side of the common plane (and is preferably more distant from the common plane than the one of the third and fourth pivot members) when the levers assume their predetermined positions.

At least one of the third and fourth pivot members is or can be integral with the respective lever, and the link is then provided with a hole for the integral pivot member.

The bearing element of the main component can comprise or constitute a hollow housing having preferably elongated slot-shaped first and second openings for the first and second levers. At least one of the levers preferably abuts a surface bounding a portion of the respective opening in the predetermined positions of the levers. Furthermore, at least one of the levers preferably abuts and is arrested by the internal surface of the housing in the predetermined positions of the levers.

The levers are further pivotable to second positions in which the chair is collapsed and in which the axes of one of the first and second pivot members and one of the third and fourth pivot members are disposed at one side of a second plane including the axes of the other two pivot members. The other of the third and fourth pivot members is then nearer to the second plane than the other of the first and second pivot members. At least one of the levers can be provided with a recess and the other lever then includes a portion which passes through the recess during at least one stage of pivotal movement of the levers between their predetermined and second positions. The recess is preferably provided in that lever which is connectable to the back of a collapsible chair.

Each lever can comprise a first arm-extending from the bearing element of the main component and a second arm which is coupled to the link, and one of the second arms can be provided with a socket or recess which receives a protuberance of the other second arm in the predetermined positions of the levers. The arrangement may be such that the protuberance abuts the surface bounding the socket to block one of the levers against movement from its predetermined position (the pivoting of the levers to their second positions then necessitates a pivoting of the lever which is provided with the protuberance).

The novel features which are considered as characteristic of the invention are set forth in particular in the appended claims. The improved joint itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
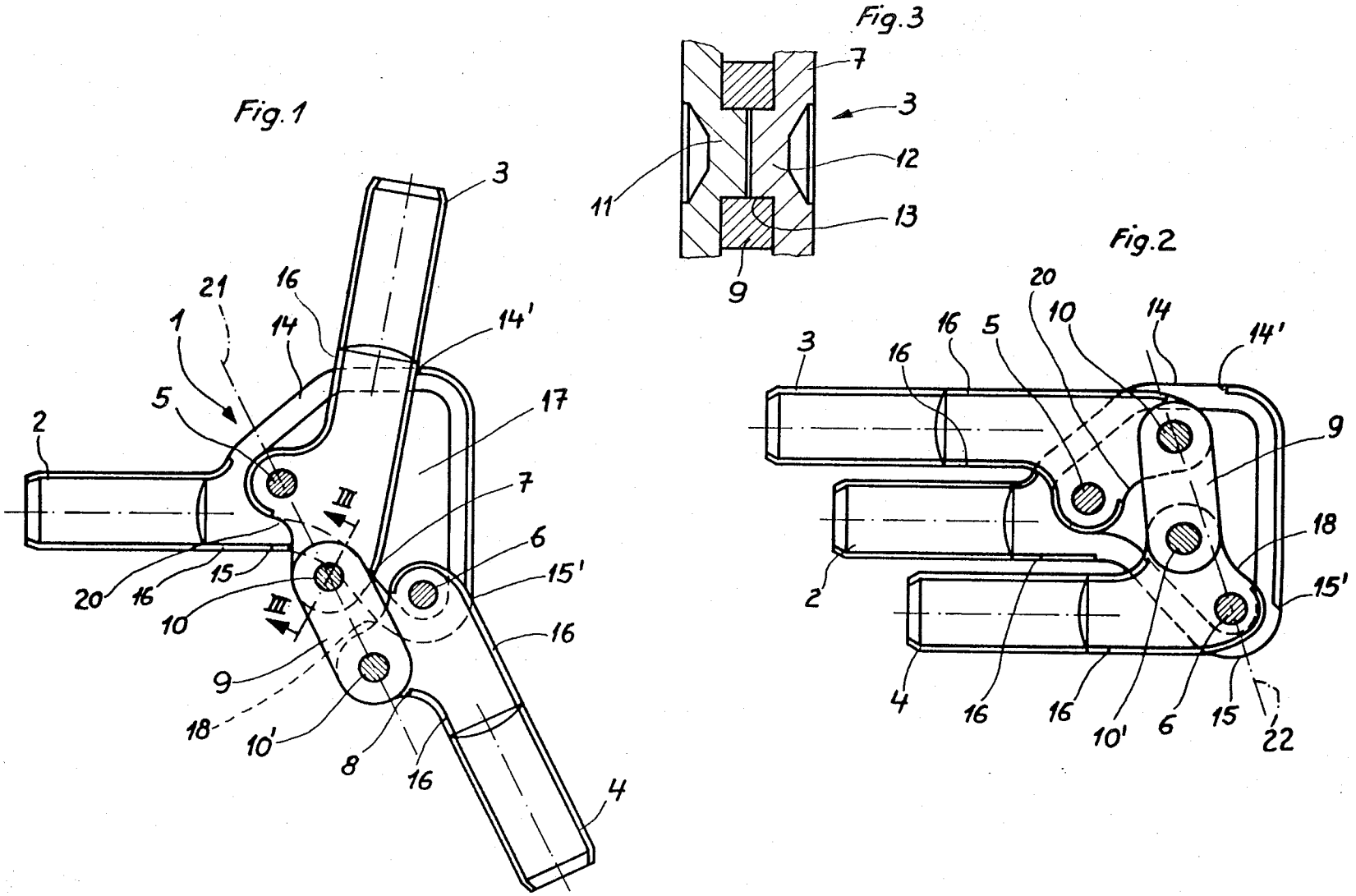
FIG. 1 is a central sectional view of a joint which embodies one form of the invention, the levers of the joint being shown in positions they assume when the chair embodying the joint is erected and ready for use.
FIG. 2 is a similar view of the joint but showing the levers in positions they assume when the chair is collapsed.
FIG. 3 is an enlarged fragmentary sectional view of one of the levers and of the link as seen in the direction of arrows from the line III—III of FIG. 1.

FIGS. 1 and 2 show a joint which comprises a main component 1 having a first portion or stub 2 which can be inserted into a portion of the seat of a collapsible chair. A second portion 17 of the component constitutes a bearing element in the form of a two-piece housing 17 having two mirror symmetrical halves or shells only one of which can be seen in FIGS. 1 and 2. The joint further comprises a first two-armed lever 3 whose longer arm constitutes a stub and extends from the housing 17 outwardly through an opening in the form of an elongated slot 14 provided in the edge face of one or in the edge faces of both halves or shells of the housing. A second two-armed lever 4 has a longer arm in the form of a stub which extends outwardly through a second elongated slot 15 of the housing 17. The bifurcated shorter arms 7 and 8 of the levers 3 and 4 are movable into and from the interior of the housing 17, and the levers 3, 4 are respectively pivotable about the axes of two parallel pivot members in the form of rivets 5, 6. The shorter arms 7, 8 of the levers 3, 4 are articulately connected to each other by a relatively short link 9. One end portion of the link 9 is coupled to the shorter arm 7 of the lever 3 by a pivot member 10 which includes two mirror symmetrical halves 11, 12 constituting integral parts of the shorter arm 7 of the lever 3 (see FIG. 3) and such halves are received in a circular hole 13 of the link 9. The other end portion of the link 9 is coupled to the bifurcated shorter arm 8 of the lever 4 in similar fashion. The two-piece pivot member is denoted by the character 10'. The axes of the pivot members 10, 10' are parallel to the axes of the pivot members 5, 6.

The levers 3, 4 are pivotable with reference to the main component 1 through angles of between approximately 90 and 120 degrees between operative or predetermined positions which are shown in FIG. 1 and inoperative or second positions shown in FIG. 2. The longer arm of the lever 3 is received, or is receivable, in a portion of the back of a collapsible chair, and the longer arm of the lever 4 is received, or is receivable, in a portion of a rear foot of the chair. The heads (not shown) at the ends of the pivot members 5 and 6 serve as a means for more or less permanently securing the two halves or shells of the housing 17 to each other.The two-piece pivot members 10, 10' can be replaced with rivets or bolts and nuts without departing from the spirit of the invention.

The main component 1 and each of the levers 3 and 4 can be made of two mirror symmetrical halves, e.g., of two suitably deformed sheet metal blanks. Thus, the stub 2 and the stubs of the levers 3, 4 can be hollow and each such part can comprise a substantially flat portion. The flat portion of the main component 1 is the two-piece housing 17, the flat portion of the lever 3 is the shorter arm 7 and the part which is traversed by the pivot member 5 and extends toward and through the opening 14, and the flat portion of the lever 4 includes the shorter arm 8 as well as the part which is traversed by the pivot member 6 and extends toward and through the opening 15. The arms 7 and 8 are recessed so as to provide room for the respective end portions of the link 9. The marginal portions 16 of the flat portions of the main component 1 and levers 3, 4 are suitably bent so as to abut each other except in the regions where the respective end portions of the link 9 extend into the levers 3 and 4 and the flat portions of the levers 3, 4 extend from the housing 17. The arrangement is preferably such that the external surfaces of flat portions of the levers 3, 4 are slidable along the internal surfaces of the mirror symmetrical halves of the housing 17. This reduces the likelihood of buckling when the joint is subjected to pronounced stresses, e.g., when the chair is not collapsed and is occupied by a heavy person or by several persons.

The surfaces 14' and 15' bounding certain portions of the openings 14 and 15 serve as stops for the flat portions of the corresponding levers 3, 4 in the first positions (FIG. 1) of the levers, i.e., when the chair embodying the improved joint is erected. The axes of the pivot members 5, 10 and 10' are then located in or close to a predetermined plane 21 which is indicated in FIG. 1 by a phantom line. Sockets in the form of recesses 18 and 20 are respectively provided in the shorter arms 8 and 7 of the levers 4 and 3 so as to allow for unimpeded pivoting of such levers to and from the positions of FIG. 1.

FIG. 2 shows the levers 3 and 4 in their second positions in which the chair using the improved joint is collapsed and the longer arms or stubs of the levers 3, 4 flank the stub 2 of the main component 1. The axes of the pivot members 10', 5 are then located at the same side of a plane 22 (indicated in FIG. 2 by a phantom line) which includes the axes of the pivot members 6 and 10. The link 9 and the shorter arms 7, 8 of the levers 3, 4 are then confined in the interior of the housing 17.

The construction of the joint in such a way that the axes of the pivot members 5, 10 and 10' are located in a common plane (21) in the erected position of the chair which embodies the joint ensures that, if the rear foot or leg which carries or which is connected to the stub of the lever 4 is acted upon to pivot in a (clockwise) direction toward the position of FIG. 2, the pivot members 5, 10, 10' effectively block such angular movement of the lever 4. This blocking takes place regardless of whether or not the back of the chair is stressed so that the chair cannot collapse (with attendant danger of injury to the occupant or occupants) while the seat is occupied and an occupant or another person rocks the back and the lever 3 back and forth. The safety of the joint can be enhanced still further by locating the pivot member 10 in such a way that its axis is disposed slightly to the left of the line 21 (which then denotes a plane including the axes of the pivot members 5 and 10'). In view of such positioning of the axis of the pivot member 10, a tendency of the lever 4 to pivot toward the position of FIG. 2 results in the generation of a moment which is not or need not be very pronounced but tends to urge the lever 3 against the surface 14' in the opening 14, i.e., the lever 3 cooperates with the link 9 to block a pivoting of the lever 4 from the position of FIG. 1. The chair can be readily collapsed by pivoting the lever 3 in a counterclockwise direction, i.e., by engaging the back which is attached to the stub of the lever 3 and by causing the back to move the lever 3 from the position of FIG. 1 to that which is shown in FIG. 2. As shown in FIG. 2, the pivot member 10' (or at least the axis of this pivot member) is located to the left of the straight line 22 denoting the plane which includes the axes of the pivot members 6 and 10, i.e., the axes of the pivot members 10' and 5 are then located at the same side of the plane which is denoted by the line 22. The longitudinal direction of the link 9 nearly coincides with the line denoting the plane 22 (i.e., the angles between the line 22 and the lines connecting the axes of the pivot members 6 and 10 with the axis of the pivot member 10' are very small) so that the joint produces a large closing or locking moment which ensures a retention of the stub 2 and the stubs of the levers 3 and 4 in substantial parallelism with each other.

Figure 5:
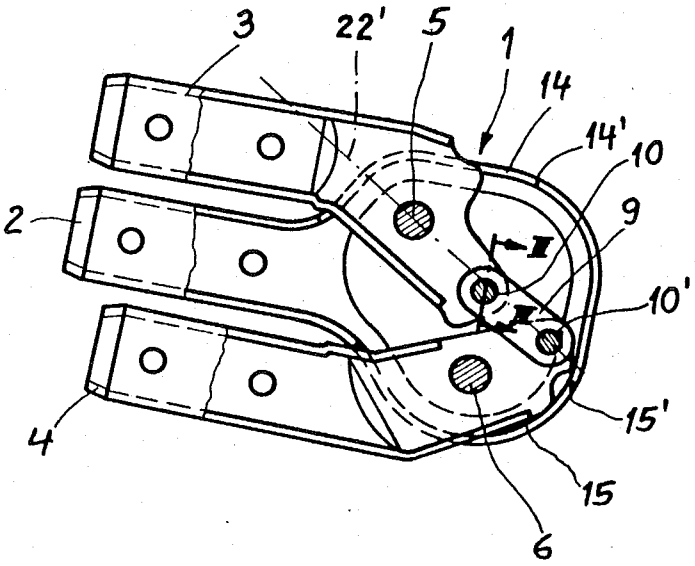
FIG. 5 shows the levers of the modified joint in positions corresponding to those of the levers in FIG. 2.
Figure 4:
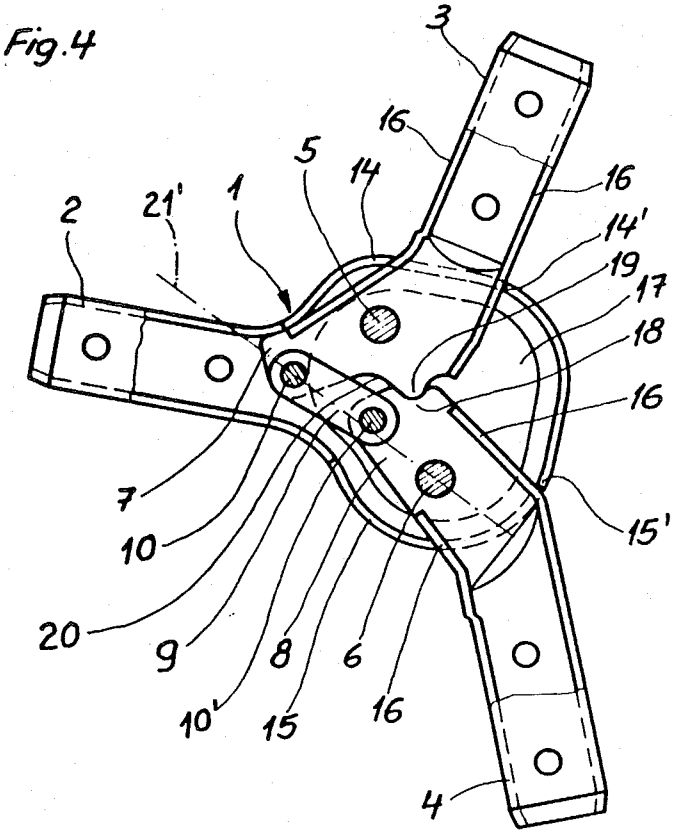
FIG. 4 is a sectional view of a modified joint with the levers in positions corresponding to those shown in FIG. 1.

FIGS. 4 and 5 show a modified joint. All such parts of this joint which are identical with or clearly analogous to the corresponding parts of the joint of FIGS. 1–2 are denoted by similar reference characters. The levers 3, 4 have dogleg-shaped inner arms 7, 8 and the pivot members 5, 6 are spaced apart from the junctions of the mutually inclined sections of the levers 3 and 4. The pivot members 10 and 10' are provided on or extend through the free ends of the respective arms 7 and 8. The surfaces 14', 15' bounding certain portions of the slot-shaped openings 14, 15 again serve as abutments or stops for the respective levers 3, 4 when these levers assume the positions of FIG. 4 in which the joint is ready to maintain the chair in erected position. At the same time, the free end portion of the arm 7 of the lever 3 abuts against the internal surface of the housing 17. This ensures that the link 9 need not take up and/or transmit pronounced stresses when the levers 3 and 4 assume the positions of FIG. 4 because the tip of the arm 7 bears against the internal surface of the housing 17 at one side of the pivot member 5 and the lever 3 also bears against the surface 14' at the other side of the pivot member 5. In order to further reduce the stress upon the link 9 in actual use of the chair, the arm 8 has a socket or recess 18 for a complementary protuberance 19 of the arm 7. The protuberance 19 is received in the socket 18 and abuts the surface surrounding the socket 18 when the levers 3 and 4 assume the positions of FIG. 4; at such time, the arms 7 and 8 cooperate to prevent further pivoting of the lever 3 in a clockwise direction and/or further pivoting of the lever 4 in a counterclockwise direction. Moreover, the configuration of the protuberance 19 and of the surface bounding the socket 18 can be such that the arms 7 and 8 are interlocked and hold the levers 3, 4 against pivotal movement in directions to allow the chair to collapse. At the very least, the lever 4 (which is connected to a rear leg or foot of the chair) is prevented from pivoting toward the position of FIG. 5. The joint of FIG. 4 is then collapsible only in response to pivoting of the back which is attached to the stub of the lever 3.

In the embodiment of FIG. 4, the line 21' denotes a plane which includes the axes of the pivot members 6, 10 and is close to the axis of the pivot member 10'. The line 22' of FIG. 5 denotes the plane which includes the axes of the pivot members 5, 10' and is close to the axis of the pivot member 10.

The protuberance 19 is adjacent to a recess or socket 20 which is provided in the arm 7 and is configurated in such a way that it allows the lever 3 to pivot relative to the lever 4 in order to move toward the position of FIG. 5.

The positioning of the axes of pivot members 5, 6, 10, 10' in a manner as shown in FIG. 1 or 4 (when the chair is erected) and in a manner as shown in FIG. 2 or 5 (when the chair is collapsed) ensures a highly satisfactory utilization of the maximum available angle for pivoting of the levers 3, 4 between their operative and inoperative. It will be seen that the axis of the pivot member 5 or 6 is more distant from the line 22 or 22' than the axis of the pivot member 10' or 10, and the axes of the pivot members 5, 10' and 6, 10 are disposed at the same (lefthand) side of the line 22 or 22'. Such arrangement allows for a highly satisfactory transmission of forces to the back of the chair during pivoting of the levers 3, 4 to the positions of FIG. 1 or 4 as well as to the positions of FIG. 2 or 5.

The positioning of the axis of the pivot member 10 (FIG. 1) or 10' (FIG. 4) at one side of and close to the line 21 or 21' renders it possible to ensure that the lever 3 or 4 is much less likely to accidentally leave the position of FIG. 1 or 4, i.e., the lever 3 or 4 is actually blocked in the erected position of the chair.

The utilization of pivot members which are integral with the respective arms 7, 8 (FIG. 3) contributes to compactness and strength of the joint because the arms 7 and 8 need not be formed with holes; on the contrary, the projections 11, 12 reinforce the halves of the respective arms. Moreover, the assembling of the link 9 with the arms 7, 8 is completed as soon as the pairs of projections 11, 12 enter the respective holes 13 of the link, i.e., it is not necessary to deform the end portions of shanks of rivets or like coupling elements.

The feature that the levers 3, 4 abut the surfaces 14', 15' in the erected position of the chair contributes to stability of the joint and of the entire chair. The same applies for the feature that the arm 7 abuts the internal surface of the housing 17 when the levers 3, 4 assume the positions which are shown in FIG. 4. This ensures that the link 9 is not called upon to take up pronounced stresses; the stresses are taken up directly by the housing 17.

The socket 18 can resemble a tooth space and the protuberance 19 can constitute a tooth which abuts at least a portion of the surface surrounding the socket when the levers 3, 4 assume the positions of FIG. 4. This renders it possible to transmit stresses directly from the lever 3 to the lever 4 or vice versa, i.e., to reduce the magnitude of stresses which must be taken up by the link 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A joint, particularly for use in a collapsible chair, comprising first and second levers; a main component including an end portion constituting a bearing element; first and second pivot members respectively connecting said first and second levers to said bearing element; a link having spaced-apart first and second portions; and third and fourth pivot members respectively connecting said first and second portions to said first and second levers in such a manner that said first and second levers are coupled to one another for joint movement, said pivot members being parallel to each other, and said levers being pivotable with reference to said component to and from predetermined positions in which the axes of said third and fourth pivot members and the axis of one of said first and second pivot members are disposed in or close to a common plane.

2. The joint of claim 1 wherein, in said predetermined positions of said levers, one of said third and fourth pivot members is relatively close to one side of said common plane and the axis of the other of said first and second pivot members is disposed at said one or at the other side of said common plane.

3. The joint of claim 1, wherein at least one of said third and fourth pivot members is integral with the respective lever and said link has a hole for said integral pivot member.

4. The joint of claim 1, wherein said bearing element includes a hollow housing respectively having first and second openings for said first and second levers and first and second surfaces bounding portions of the respective openings, at least one of said levers abutting the respective surface in said predetermined position of such lever.

5. The joint of claim 1, wherein said bearing element includes a housing for portions of said levers, said housing having an internal surface and said portion of one of said levers abutting said internal surface in said predetermined positions of said levers.

6. The joint of claim 1, wherein said levers are further pivotable to second positions in which the axes of a selected one of said first and second pivot members and a selected of said third and fourth pivot members are disposed at one side of a second plane including the axes of the other two pivot members.

7. The joint of claim 6 wherein, in the second positions of said levers, the selected one of said third and fourth pivot members is nearer to said second plane than the selected one of said first and second pivot members.

8. The joint of claim 6, wherein at least one of said levers has a recess and the other of said levers has a portion which passes through said recess during at least one stage of pivotal movement of said levers between said predetermined positions and said second positions thereof.

9. The joint of claim 8, wherein said component is connectable to the seat of a collapsible chair and said first and second levers are respectively connectable to the back and to the leg of such collapsible chair, said recess being provided in said first lever.

10. The joint of claim 1, wherein each of said levers comprises a first arm extending from said bearing element and a second arm, said link being pivotally connected to the second arms of said levers, one of said second arms having a socket and the other of said arms having a protuberance which extends into said socket in said predetermined positions of said levers.

11. The joint of claim 1, wherein at least one of said levers has a recess and a surface bounding said recess, the other of said levers having a protuberance which abuts said surface in said predetermined positions of said levers to thereby block one of said levers against movement from its predetermined position.

12. The joint of claim 1, wherein at least one of said levers has a socket and the other of said levers comprises a portion which extends into said socket to block the pivoting of one of said first and second levers from its predetermined position.

* * * * *